US011433503B1

(12) United States Patent
Lafever

(10) Patent No.: US 11,433,503 B1
(45) Date of Patent: Sep. 6, 2022

(54) ADJUSTABLE GRINDING SURFACE

(71) Applicant: G. Alan Lafever, Tucson, AZ (US)

(72) Inventor: G. Alan Lafever, Tucson, AZ (US)

( * ) Notice: Subject to any disclaimer, the term of this patent is extended or adjusted under 35 U.S.C. 154(b) by 367 days.

(21) Appl. No.: 16/872,901

(22) Filed: May 12, 2020

(51) Int. Cl.
*B24B 41/047* (2006.01)
*B24B 47/12* (2006.01)

(52) U.S. Cl.
CPC ..... *B24B 41/047* (2013.01); *B24B 47/12* (2013.01)

(58) Field of Classification Search
CPC ..... B24B 41/047; B24B 47/12
USPC ..... 318/3; 451/259
See application file for complete search history.

(56) References Cited

U.S. PATENT DOCUMENTS 5,681,209 A * 10/1997 Naumann ..... B24D 7/18 451/52

* cited by examiner

*Primary Examiner* — David Luo
(74) *Attorney, Agent, or Firm* — Hayes Soloway P.C.

(57) ABSTRACT

An adjustable grinding apparatus includes a grinder having a motor and grinding disk. A grinder base houses the motor. The grinder base has at least one sidewall extending around at least a portion of the motor. An adjustable motor support includes a motor support surface positioned between the motor and the grinding disk. First, second arms are affixed to first and second ends of the motor support surface and rotatably secured to the at least one sidewall. At least one of the first, second arms has at least one slotted cutout. A locking mechanism is in communication with at least one of the first and second arms and the at least one sidewall through at least one slotted cutout. The grinder and the adjustable motor support are rotatable about the grinder base to adjust a grinding orientation of the grinder. A grinder position is fixable by tightening the locking mechanism.

20 Claims, 8 Drawing Sheets

Method For Adjusting An Orientation Of A Grinder

Method For Adjusting An Orientation Of A Grinder

700

ADJUSTABLE GRINDING SURFACE

FIELD OF THE DISCLOSURE

The present disclosure is generally related to disk grinders and sanders, and more particularly is related to systems and methods for configuring the surfaces of disk grinders and sanders.

BACKGROUND OF THE DISCLOSURE

Disk grinders and sanders are useful for removing material along a plane defined by the grinding or sanding surface. A disk having a rough material is typically spun about an axis by a motor. The object being sanded or ground is typically placed against the disk at an angle orthogonal to the disk, and material is removed from the object where the disk meets the surface of the object.

Disk grinders and sanders currently known in the art are configured to be operated in a single orientation only—the grinding or sanding surface is oriented either vertically or horizontally. However, many users require sanding or grinding applications in multiple orientations. One known solution is to purchase multiple grinders or sanders in different orientations, e.g., a first device at a horizontal orientation and a second device at a vertical orientation. This requires additional cost, maintenance, and storage requirements, which is undesirable for users of small shops. Another known solution includes employing a bracket designed to secure a device at a different orientation than it is typically used, e.g. in a horizontal orientation when typically at a vertical orientation, and vice-versa. These brackets are limited in their configurability and require the use of tools and complex processes to reconfigure.

Thus, a heretofore unaddressed need exists in the industry to address the aforementioned deficiencies and inadequacies.

SUMMARY OF THE DISCLOSURE

Embodiments of the present disclosure provide a system and apparatus for an adjustable grinder. Briefly described, in architecture, one embodiment of the apparatus, among others, can be implemented as follows. An adjustable grinding apparatus includes a grinder having a motor in communication with a grinding disk. A grinder base houses the motor. The grinder base has at least one sidewall extending around at least a portion of the motor. An adjustable motor support includes a motor support surface positioned between the motor and the grinding disk. First and second arms are affixed to first and second ends, respectively, of the motor support surface and rotatably secured to the at least one sidewall of the grinder base. At least one of the first and second arms has at least one slotted cutout. A locking mechanism is in communication with at least one of the first and second arms and the at least one sidewall of the grinder base through the at least one slotted cutout. The grinder and the adjustable motor support are rotatable about the grinder base to adjust a grinding orientation of the grinder. A position of the grinder is fixable by tightening the locking mechanism.

The present disclosure can also be viewed as providing an apparatus for housing a grinder. Briefly described, in architecture, one embodiment of the apparatus, among others, can be implemented as follows. An adjustable housing for a grinder includes a grinder base having an interior volume and at least one sidewall extending around at least a portion of the interior volume. A motor support surface is included. First and second arms are affixed to first and second ends, respectively of the motor support surface and rotatably secured to the at least one sidewall of the grinder base. A locking mechanism is in communication with at least one of the first and second arms and the at least one sidewall of the grinder base. The motor support surface is rotatable about the grinder base to adjust an orientation of the motor support surface. A position of the motor support surface is fixable by engaging the locking mechanism.

The present disclosure can also be viewed as providing methods of adjusting an orientation of a grinder. In this regard, one embodiment of such a method, among others, can be broadly summarized by the following steps: providing a grinder having a motor in communication with a grinding disk; housing the motor within a grinder base having at least one sidewall, the at least one sidewall extending around at least a portion of the motor; positioning a motor support surface between the motor and the grinding disk, the motor support surface having first and second arms affixed to first and second ends of the motor support surface, at least one of the first and second arms having at least one slotted cutout; rotatably securing the first and second arms to the at least one sidewall of the grinder base; adjusting, by rotating the grinder and the motor support surface about the grinder base, a grinding orientation of the grinder; and fixing, by engaging a locking mechanism in communication with at least one of the first and second arms and the at least one sidewall of the grinder base through the at least one slotted cutout, a position of the grinder.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
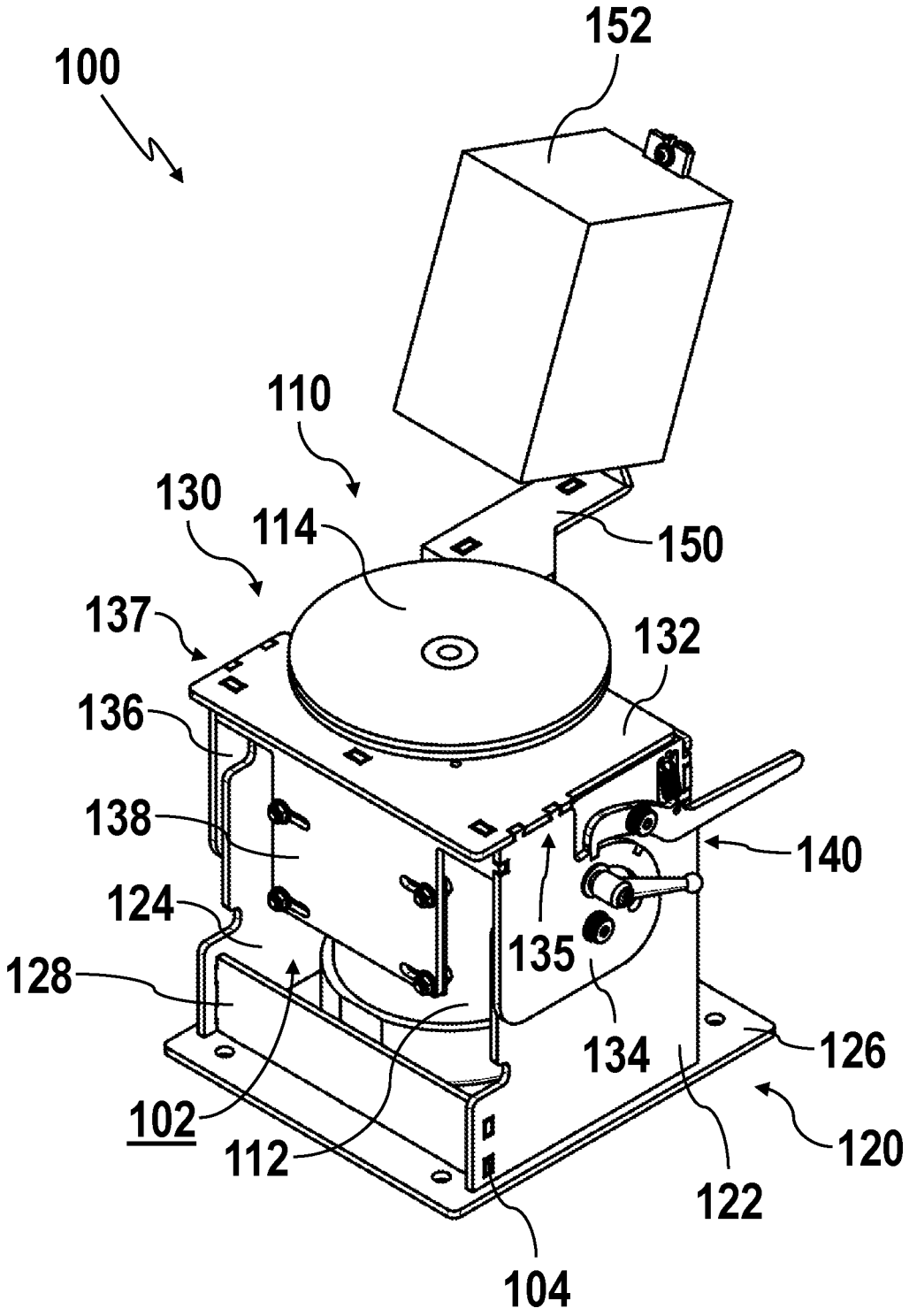
FIG. 1 is an isometric illustration of an adjustable grinding apparatus, in accordance with a first exemplary embodiment of the present disclosure.

FIG. 1 is an isometric illustration of an adjustable grinding apparatus 100, in accordance with a first exemplary embodiment of the present disclosure. The adjustable grinding apparatus (hereinafter, "apparatus") 100 includes a grinder 110 having a motor 112 in communication with a grinding disk 114. A grinder base 120 houses the motor 112. The grinder base 120 has at least one sidewall 122, 124 extending around at least a portion of the motor 112. An adjustable motor support 130 includes a motor support surface 132 positioned between the motor 112 and the grinding disk 114. First and second arms 134, 136 are affixed to first and second ends 135, 137, respectively, of the motor support surface 132 and rotatably secured to the at least one sidewall 122, 124 of the grinder base 120. At least one of the first and second arms 134, 136 has at least one slotted cutout, shown in greater detail in FIG. 2, below. A locking mechanism 140 is in communication with at least one of the first and second arms 134, 136 and the at least one sidewall 122, 124 of the grinder base 120 through the at least one slotted cutout. The grinder 110 and the adjustable motor support 130 are rotatable about the grinder base 120 to adjust a grinding orientation of the grinder 110. A position of the grinder 110 is fixable by tightening the locking mechanism 140.

A grinder 110 has a motor 112 in communication with a grinding disk 114. The motor 112 may be any suitable motor for use in grinding and sanding applications. In one example, the motor 112 may be a 1½ horsepower A/C motor. The motor 112 may include a power source, such as alternating current provided through a wall outlet, direct current provided by a battery, and the like. The grinding disk 114 may be any suitable rotary grinding surface, material, or structure. As used herein, the term "grinding" may refer to any action that removes material through the contact of a rotary abrasive, including sanding and polishing. The grinding disk 114 may include any suitable type of grinding disk or wheel, including aluminum dioxide, diamond, fiberglass, silicon carbide, zirconia, and the like. The grinding disk 114 may include any suitable type of sanding disk, including aluminum oxide, ceramic, felt, silicon carbide, zirconia, and the like. The grinding disk 114 may also include any suitable type of surface conditioning disk, including felt, nylon, sandpaper, and the like. It should be understood that the grinding disk 114 may include any suitable size, grit, and attachment mechanism known in the art. The grinding disk 114 may be in mechanical communication with the motor 112, i.e., may be attached for operation to the motor 112 by any suitable means, including adhesives, magnets, clips, fasteners, and the like.

Figure 4A:
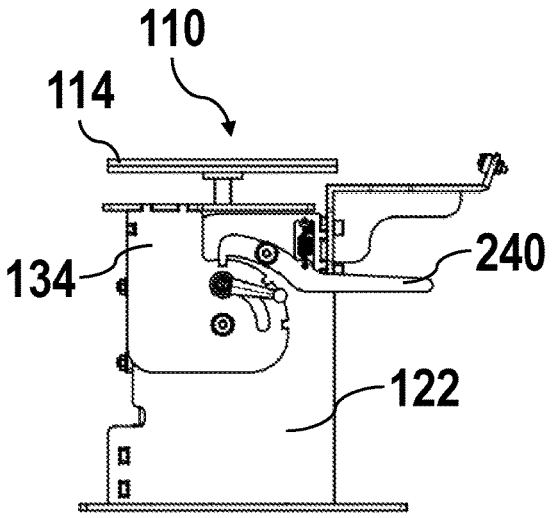
FIGS. 4A-4C are side view illustrations showing the orientation of the grinder being adjusted, in accordance with the first exemplary embodiment of the present disclosure.
Figure 4B:
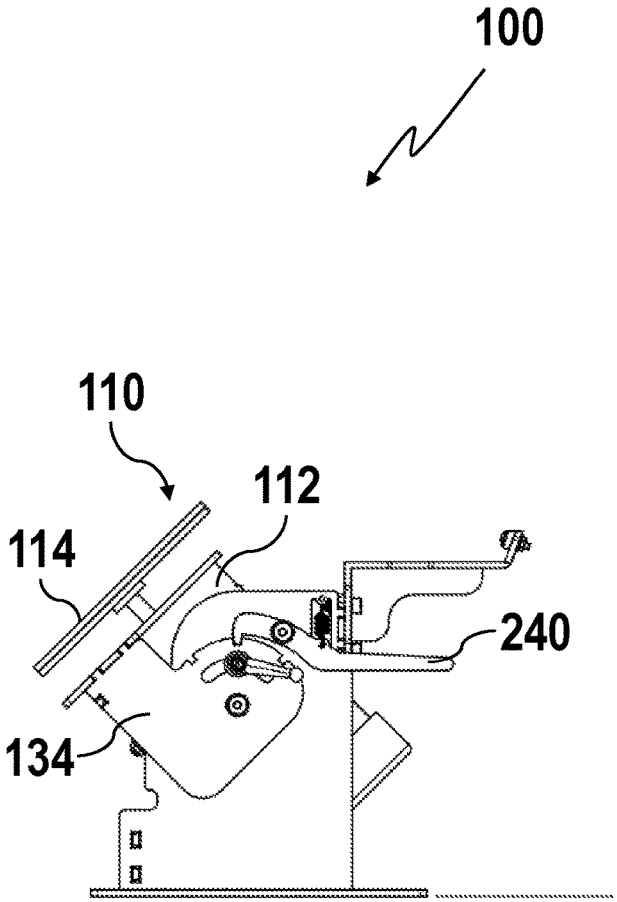
Figure 4C:
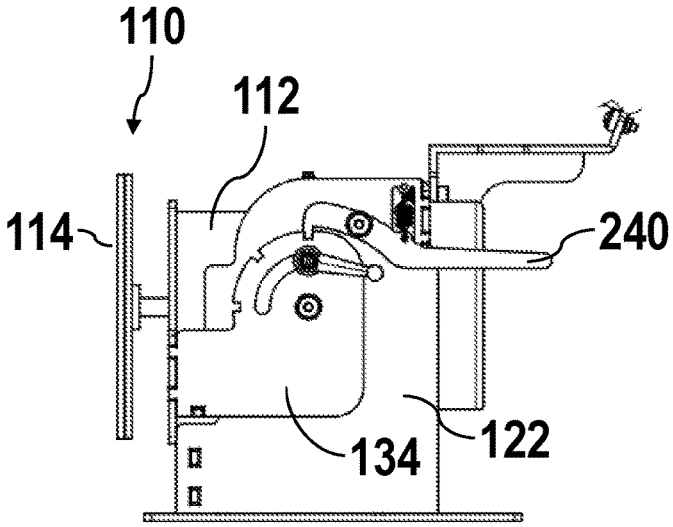

A grinder base 120 houses the motor 112. The grinder base 120 may provide a structure at least partially enclosing the motor 112 in order to facilitate rotation and adjustment of the grinder 110's orientation. In one example, the grinder base 120 may include at least one sidewall 122, 124 extending around at least a portion of the motor 112. FIG. 1 shows two sidewalls 122, 124 positioned substantially parallel to one another at substantially opposite sides of a base plate 126. The sidewalls 122, 124 may be affixed to the base plate 126 by any suitable means, including welding, fasteners, adhesives, and the like. In one example, welding tabs 104 may be formed into any of the connecting components, including the sidewalls 122, 124, base plate 126, adjustable motor support 130, and cross member 128, to make alignment and assembly easier. In one example, the sidewalls 122, 124 may be formed unitary or monolithic with the base plate 126. The sidewalls 122, 124 may be oriented vertically to provide vertical support for the adjustable motor support 130 and to suspend the motor 112 and grinding disk 114. This may allow the grinder 110 to rotate freely during operation. The sidewalls 122, 124 may extend to a height at least a vertical length of the motor 112 to allow the motor 112 to fit within the interior volume 102 of the grinder base 120. In one example, the sidewalls 122, 124 may extend longer than the vertical length of the motor 112 to provide clearance when the motor 112 is rotatably adjusted. The motor 112 may be oriented in any suitable direction for operating and adjusting the grinder 110. For example, FIG. 1 shows the motor 112 having an elongate axis in the vertical direction, the elongate axis parallel to a rotating axis of the grinding disk 114. The motor 112 is rotatably adjustable between this vertical orientation and a horizontal orientation, as shown in FIGS. 4A-4C below. However, motors having horizontal orientations or any other orientations should be understood to be within the scope of this disclosure.

The grinder base 120 may be any suitable shape to house the grinder 110 and adjust the grinding orientation. By way of example, FIG. 1 shows a grinder base 120 having a generally box shape; the sidewalls 122, 124 and the base plate 126 are substantially rectangular. In one example, the grinder base 120 may not include a base plate 126. In another example, the base plate 126 may include features for securing the grinder base 120 to a work surface. For instance, the base plate 126 may include holes for bolts, planar areas for clamps or vices, and the like.

In one example, the at least one sidewall 122, 124 may include any suitable number and orientation of sidewalls for rotatably mounting the grinder 110. For instance, the at least one sidewall 122 may be a single sidewall extending to opposite ends of the base plate 126. This may include a curved sidewall 122, for example having a U-shape with two ends substantially parallel to one another. This may also include a single sidewall piece 122 having one or more angled portions between two substantially parallel ends. The at least one sidewall 122, 124 may also include more than two sidewalls. The additional sidewalls may provide an enclosure for the motor 112, which may keep out dust, trimmings, and the like.

In one example, the grinder base 120 may completely enclose the motor 112. This may protect the motor from dust and debris, as discussed above. It may also protect the motor 112 from accidental contact with the user or with other materials in the shop, which may affect the orientation of the grinding surface. The enclosed grinder base 120 may be any suitable shape, including box, oblong, cylindrical, and the like. The enclosed volume of the grinder base 120 may allow the motor 112 to rotate freely therein.

The grinder base 120 may further include any additional members or components to improve stability, provide protection, or interface with other components. For example, the grinder base 120 may include a cross member 128 connected between the sidewalls 122, 124 and affixed to the base plate 126. The cross member 128 may have a height that allows the grinder 110 to rotate freely between a first orientation and a second orientation, such that the height of the cross member 128 does not cross a motion path of the grinder 110 or motor support 130. For example, when the grinder 110 and motor support 130 are oriented with the grinding disk 114 in a vertical position, the motor 112 may be positioned above the cross member 128. Cross member 128 may also hold a movable support table against the grinder base 120, which may provide a supportive surface for the object being ground.

The grinder base 120 may be formed from any suitable material, including metal, plastic, wood, ceramic, polymer, and the like. The grinder base 120 generally may be rigid and may be strong enough to support the weight of the grinder 110, the material being ground, and the force applied to operate the grinder 110. In one example, the grinder base 120 may be formed from ¼-inch steel.

An adjustable motor support 130 includes a motor support surface 132 positioned between the motor 112 and the grinding disk 114. The motor support 130 may be made from any suitable material, and in one example may be made from the same material as the grinder base 120. The motor support surface 132 may be substantially planar, and may be oriented substantially parallel to the grinding disk 114. In one example, a surface area of the motor support surface 132 may be larger than a surface area of the grinding disk 114. For instance, the length and/or width of the motor support surface 132 may be larger than the grinding disk 114. This may shield the motor 112 and other portions of the grinder base 120 from debris and other particulates during the grinding process. In one example, the motor support surface 132 may be generally shaped as a rectangle, and may extend between the at least one sidewall 122, 124. In a first position, the motor support surface 132 may, for example, have a horizontal orientation, and may be rotatably adjusted to a vertical orientation, or any orientation therebetween.

First and second arms 134, 136 may be affixed to first and second ends 135, 137, respectively, of the motor support surface 132. The first and second arms 134, 136 may be affixed by any suitable means, including welding, fasteners, adhesive, or other methods. In one example, the first and second arms 134, 136 may be manufactured as a unitary, monolithic piece with the motor support surface 132. The first and second arms 134, 136 may be substantially parallel to one another and may in at least some portions be substantially perpendicular to the motor support surface 132. This may allow the first and second arms 134, 136 to be secured to the at least one sidewall 122, 124. The first and second arms 134, 136 may be any suitable shape. In the example shown in FIG. 1, each of the arms 134, 136 may be substantially planar and may be substantially parallel with the sidewalls 122, 124. A front edge of the first and second arms 134, 136 may be configured to substantially align with and partially overlap a front edge of the sidewalls 122, 124 when in a vertical orientation. A top edge of the first and second arms 134, 136 may be configured to substantially align with a top edge of the first and second arms 134, 136 when in a vertical orientation. This is shown in greater detail in FIG. 4A, below. When in a horizontal orientation, the top edge of the first and second arms 134, 136 may substantially align with the cross member 128. This is shown in greater detail in FIG. 4C, below.

In one example, the first and second arms 134, 136 may extend from the motor support surface 132 at right angles. As shown in FIG. 1, the motor support 130 may, for example, have squared edges where the motor support surface 132 and the arms 134, 136 are joined. In another example, the edges may be curved, rounded, or beveled, or have any other shape that allows the motor support surface 132 to provide support to the grinder 110 and the arms 134, 136 to be rotatably secured to the at least one sidewall 122, 124.

The adjustable motor support 130 may be positioned over an exterior of the sidewalls 122, 124, including exterior side and top surfaces, as is shown in FIG. 1. In operation, the movement of the adjustable motor support 130 may be exterior to the grinder base 120. In another example, the adjustable motor support 130 may be positioned substantially interior to the grinder base 120. This is discussed in greater detail in FIG. 5, below.

The adjustable motor support 130 may be rotatably secured to the at least one sidewall 122, 124 of the grinder base 120. In one example, the first and second arms 134, 136 may be secured to the sidewalls 122, 124, respectively. The arms 134, 136 may be secured by any suitable means, including rotating bolts, fasteners, axles, and the like. In one example, the arms 134, 136 may be secured by shoulder bolts, low friction washers, and locking nuts.

The adjustable motor support 130 may further include additional components or members. In one example, a front motor plate 138 may be in connection with the motor support surface 132. The front motor plate 138 may be affixed to the motor 112 at a front side of the apparatus 100 to provide support when the grinder 110's orientation is being adjusted. The front motor plate 138 may be any suitable size. In one example, the front motor plate 138 may be sized to fit within the interior volume 102 of the grinder base 120, and may have a vertical length and a horizontal width smaller than the interior height and width, respectively, of the grinder base 120. In another example, the front motor plate 138 may be sized to extend along at least a portion of the vertical length of the motor 112 and along at least a portion of the horizontal width of the motor 112. The front motor plate 138 may be affixed to the motor 112 at an upper portion of the motor 112. The front motor plate 138 may be any suitable shape to support the motor 112 in operation. In one example, the front motor plate 138 may be substantially planar, having a flat shape against which the motor 112 may rest when in a horizontal orientation. In another example, the front motor plate 138 may be shaped to at least partially follow the shape of the motor 112. For instance, the front motor plate 138 may be at least partially curved to conform to the shape of the round motor 112.

At least one of the first and second arms 134, 136 has at least one slotted cutout, shown in greater detail in FIG. 2, below. A locking mechanism 140 is in communication with at least one of the first and second arms 134, 136 and the at least one sidewall 122, 124 of the grinder base 120 through the at least one slotted cutout. In one example, the locking mechanism 140 may be positionable on either side of the grinder base 120 to allow left-handed or right-handed users the ability to adjust the locking mechanism 140 based on their preference.

The locking mechanism 140 may be any suitable locking mechanism capable of retaining the position of the motor support 130 and the grinder 110 after it has been rotated to a desired orientation. For example, the locking mechanism 140 may include a fastener, such as a handle, and a locking arm, as is shown in FIGS. 1-2. The locking mechanism 140 may also include ratcheting locks, spring-loaded lock buttons, cotter pins, magnetic and electromagnetic locks, and the like. The locking mechanism 140 may retain the motor support 130 and the grinder 110 when in an engaged state, and may allow the motor support 130 and the grinder 110 to rotate freely when in a disengaged state.

In one example, the grinder base 120 may include additional components for controlling the operation of the grinder 110. For example, a controller bracket 150 may be affixed to the grinder base 120. The controller bracket 150 may provide support for a speed controller 152 or other component, such as an on/off switch. In another example, the apparatus 100 may include other components typically used in grinding operations, such as dust guards, debris catchers, vacuum dust catchers, and the like.

Figure 2:
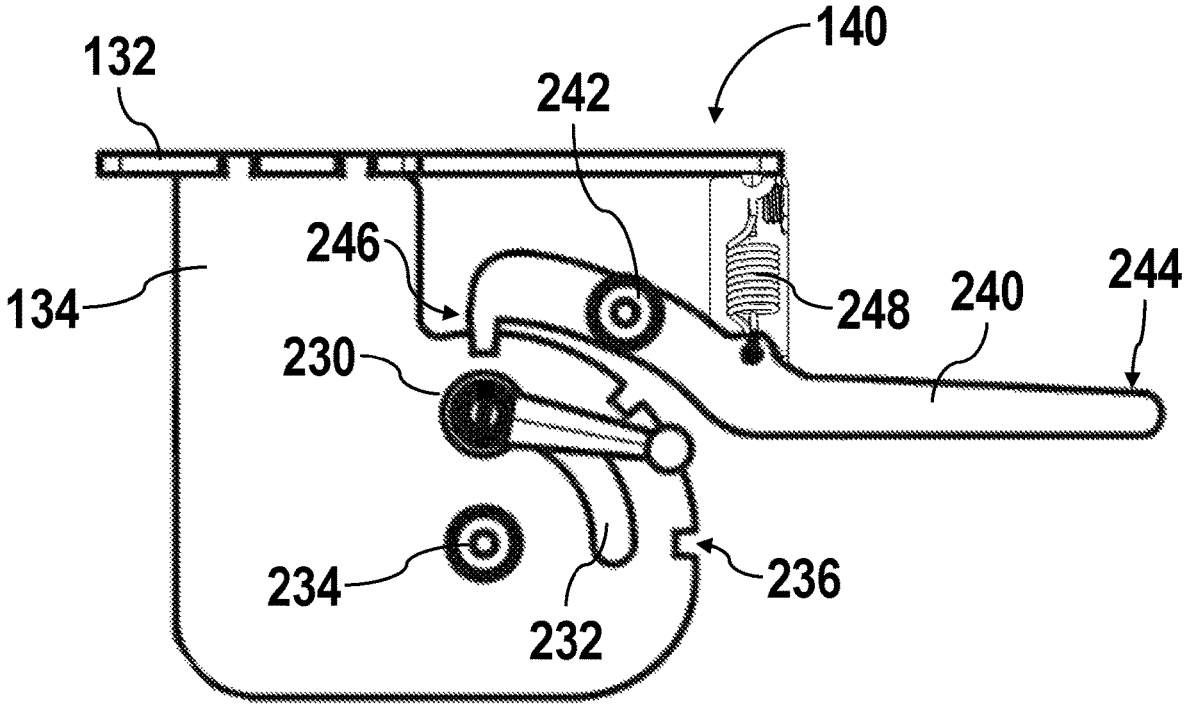
FIG. 2 is a side view illustration of the first arm, in accordance with the first exemplary embodiment of the present disclosure.

FIG. 2 is a side view illustration of the first arm 134, in accordance with the first exemplary embodiment of the present disclosure. The first arm 134 may be connected with the motor support surface 132 at a top of the first arm 134. The first arm 134 may be rotatably connected to the at least one sidewall by a bolt 234. The first arm 134 may rotate about an elongate axis of the bolt 234. The first arm 134 may include at least one slotted cutout 232 located on a planar face of the first arm 134. The at least one slotted cutout 232 may allow the rotating first arm 134 to be secured in a desired orientation. In one example, the at least one slotted cutout 232 may be an arcuate cutout having a radius of curvature corresponding to the elongate axis of the bolt 234. The arcuate portion of the slotted cutout 232 may additionally correspond to a range of articulation of the first arm 134. For example, if the first arm 134 is configured to rotate about 90 degrees between a first position and a second position, the arcuate portion of the slotted cutout 232 may correspond to 90 degrees, or one-quarter circle. If the first arm 134 can rotate more or less, the arcuate portion of the slotted cutout 232 may correspond to the resultant portion of a circle. The at least one slotted cutout 232 may be aligned with a cutout in the at least one sidewall 122, shown in FIG. 3, below. A handle 230 may be fastened about a threaded fastener positioned through the at least one slotted cutout 232 and the cutout in the at least one sidewall 122. The handle 230 may be tightened to fix the position of the motor support surface 132 and may be loosened to allow the motor support surface 132 to be rotatable about the bolt 234. It should be understood that the handle 230 is provided as an exemplary fastener only. Other fastening mechanisms, such as thumbscrews, wing nuts, latches, clasps, locks, and the like may be used. The fastening mechanism may be engageable to fix the position of the motor support surface 132 and disengageable to allow rotation of the motor support surface 132.

A locking arm 240 may be rotatably affixed to the at least one sidewall 122 by an arm bolt 242. The locking arm 240 may be an elongate member having a lever end 244 and a stop end 246. The lever end 244 may be manipulated by a user to rotate the locking arm 240 about the arm bolt 242. Manipulating the lever end 244 may cause the stop end 246 to be raised and lowered. The stop end 246 may be sized and shaped to fit into a plurality of stops 236 located on a radial edge of the first arm 134. The plurality of stops 236 may be notches or small cutouts in the radial edge of the first arm 134, and may be positioned to correspond to a desired angle of rotation of the first arm 134 and the motor support surface 132. For example, the stops 236 may be located to correspond to rotation angles of 0°, 45°, and 90°, or any other desired angles. When the stop end 246 is placed into a stop 236, it may prevent further rotation of the first arm 134 until the locking arm 240 is disengaged.

In one example, a spring 248 may be connected to a point on the locking arm 240 and a point on the at least one sidewall 122. The spring 248 may be configured to provide a constant force on the lever end 244 of the locking arm 240 to maintain a position of the stop end 246 within a stop 236. The spring 248 may be any suitable type of spring, including torsion springs, extension springs, compression and die springs, and the like.

The locking arm 240 and handle 230 may be made from any suitable materials, including metal, plastic, wood, ceramic, polymer, or any combination thereof. The bolts 234,242 may be any suitable bolts and may include any necessary hardware components, including nuts, washers, caps, and the like.

It should be understood that the locking mechanism 140 and associated components may be located on the second arm 136 or on both arms. The first arm 134 shown in FIG. 2 is exemplary only.

Figure 3:
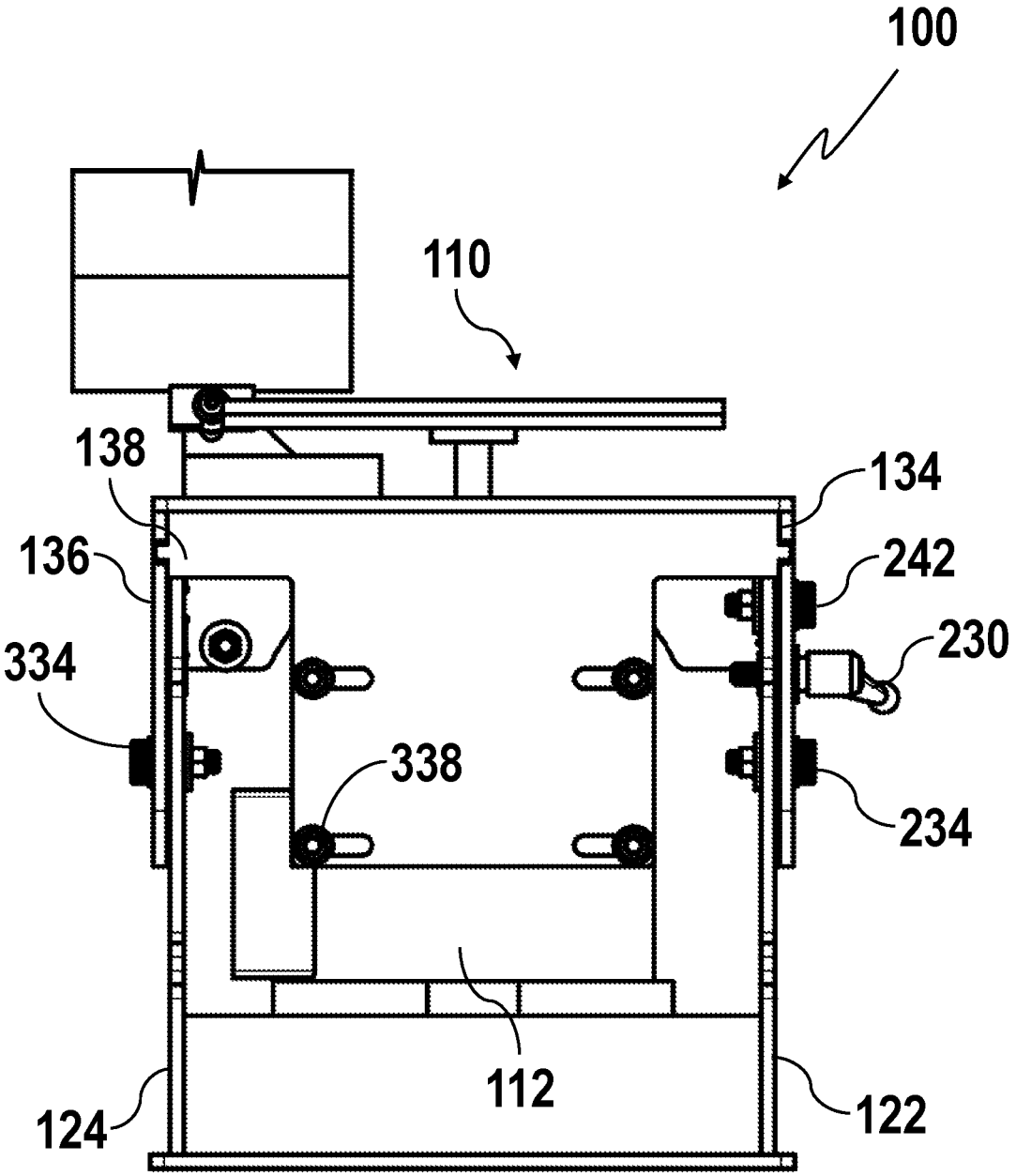
FIG. 3 is a front view illustration of the adjustable grinding apparatus, in accordance with the first exemplary embodiment of the present disclosure.

FIG. 3 is a front view illustration of the adjustable grinding apparatus 100, in accordance with the first exemplary embodiment of the present disclosure. The first and second arms 134, 136 are shown affixed to the at least one sidewall 122, 124, as discussed above relative to FIGS. 1-2. Bolts 234, 334 are positioned through the first and second arms 134, 136 and sidewalls 122, 124 to secure and allow rotation of the first and second arms 134,136. Arm bolt 242 is positioned through the first arm 134 and sidewall 122 to secure and allow rotation of the locking arm 240 (not shown). The motor 112 may be secured to the front motor plate 138 by means of at least one fastener 338. The at least one fastener 338 may be any suitable fastener, including screws, bolts, and the like. In one example, the at least one fastener 338 may be a threaded screw or bolt corresponding to threaded holes on the body of the motor 112. The fasteners 338 may secure the motor 112 through holes or cutouts on the front motor plate 138. In operation, this may allow the front motor plate 138 to provide support to the motor 112 when the grinder 110 is in a horizontal, vertical, or other angled orientation. It should also be noted that fasteners 338 may be used to secure the motor 112 to any other part of the adjustable motor support 130, such as the motor support surface 132. In one example, the fasteners 338 may be countersunk bolts used to affix the motor 112 and the motor support surface 132. This may be used instead of, or in addition to, the fasteners 338 located within the front motor plate 138.

FIGS. 4A-4C are side view illustrations showing the orientation of the grinder 110 being adjusted, in accordance with the first exemplary embodiment of the present disclosure.

FIG. 4A shows the grinder 110 in a horizontal orientation, which may be called a 0° orientation. The grinding disk 114 spins about a vertical axis, providing a horizontal grinding plane against which material may be removed. The first arm 134 is vertically aligned with the at least one sidewall 122, and the locking arm 240 is engaged within the left exterior stop.

FIG. 4B shows the grinder 110 rotated to a 45° orientation. The grinding plane of the grinding disk 114 is tilted 45° from the vertical, as are the motor 112 and the first arm 134. The locking arm 240 is engaged within the center stop.

FIG. 4C shows the grinder 110 rotated to a vertical orientation, which may be called a 90° orientation. The grinding disk 114 spins about a horizontal axis, providing a vertical grinding plane against which material may be removed. The first arm 134 is horizontally aligned with the at least one sidewall 122, and the locking arm 240 is engaged within the right exterior stop.

With regard to FIGS. 1-4C, it should be understood that the present disclosure may also be viewed as providing an apparatus for housing a grinder 110. An adjustable housing for a grinder includes a grinder base 120 having an interior volume 102 and at least one sidewall 122, 124 extending around at least a portion of the interior volume 102. A motor support surface 132 is included. First and second arms 134, 136 are affixed to first and second ends 135, 137, respectively of the motor support surface 132 and rotatably secured to the at least one sidewall 122, 124 of the grinder base 120. A locking mechanism 140 is in communication with at least one of the first and second arms 134, 136 and the at least one sidewall 122, 124 of the grinder base 120. The motor support surface 132 is rotatable about the grinder base 120 to adjust an orientation of the motor support surface 130. A position of the motor support surface 132 is fixable by engaging the locking mechanism 140.

Figure 5:
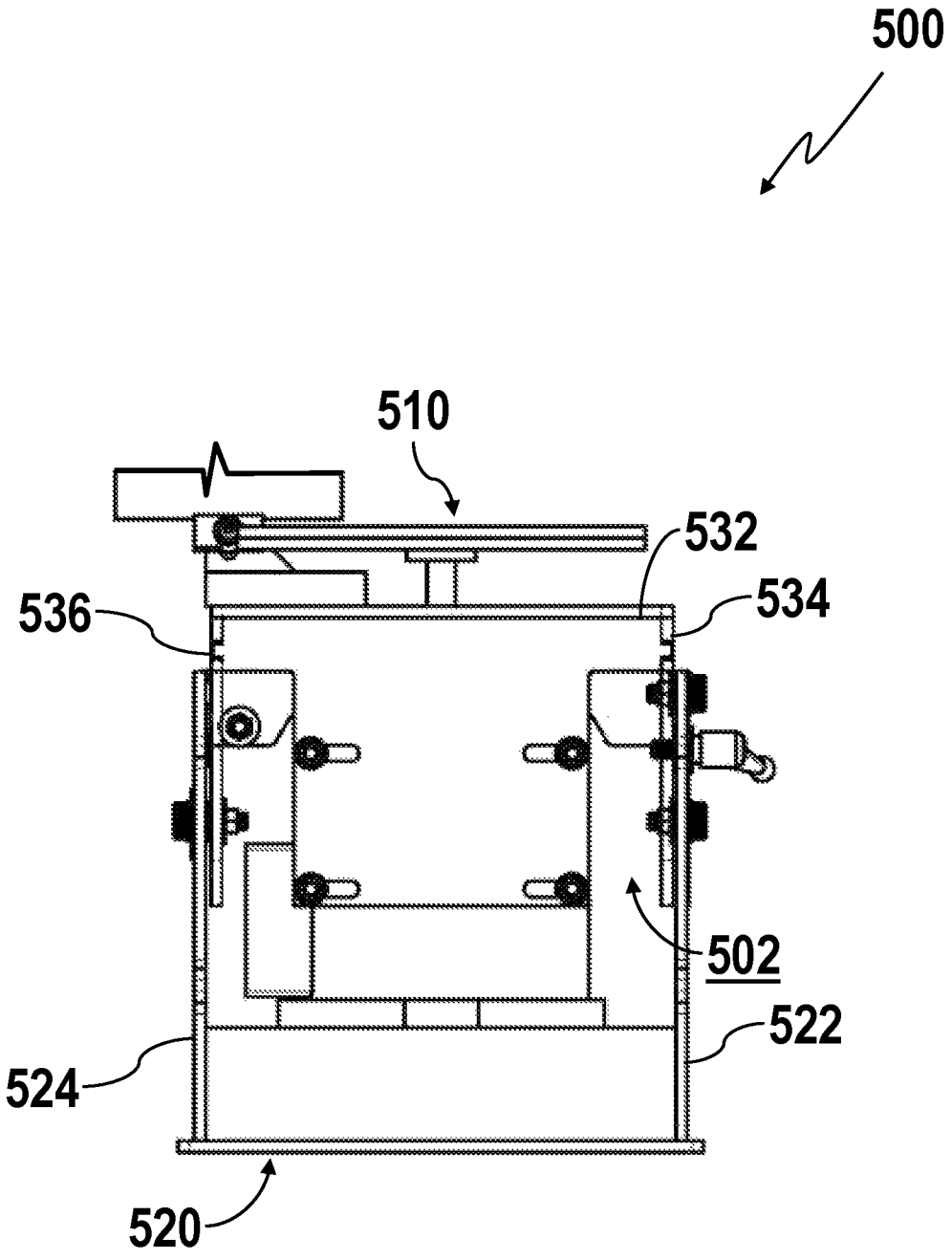
FIG. 5 is a front view illustration of the adjustable grinder with first and second arms interior to the sidewall, in accordance with the first exemplary embodiment of the present disclosure.

FIG. 5 is a front view illustration of the adjustable grinder 500 with first and second arms 534, 536 interior to the sidewall 522, 524, in accordance with the first exemplary embodiment of the present disclosure. The grinder 510 is shown at least partially within the grinder base 520, as discussed with respect to FIGS. 1-4C, above. The motor support surface 532 may be positioned between the motor and grinding disk of the grinder 510, and may extend across an upper end of the at least one sidewall 522, 524. First and second arms 534, 536 may be affixed to the motor support surface 532 at first and second ends of the motor support surface 532. The first and second arms 534, 536 may be affixed to interior surfaces of the at least one sidewall 522, 524, and may be rotatable within an interior volume 502 of the grinder base 520. At least a portion of the first and second arms 534, 536 may rotate inside the at least one sidewall 522, 524.

Figure 6:
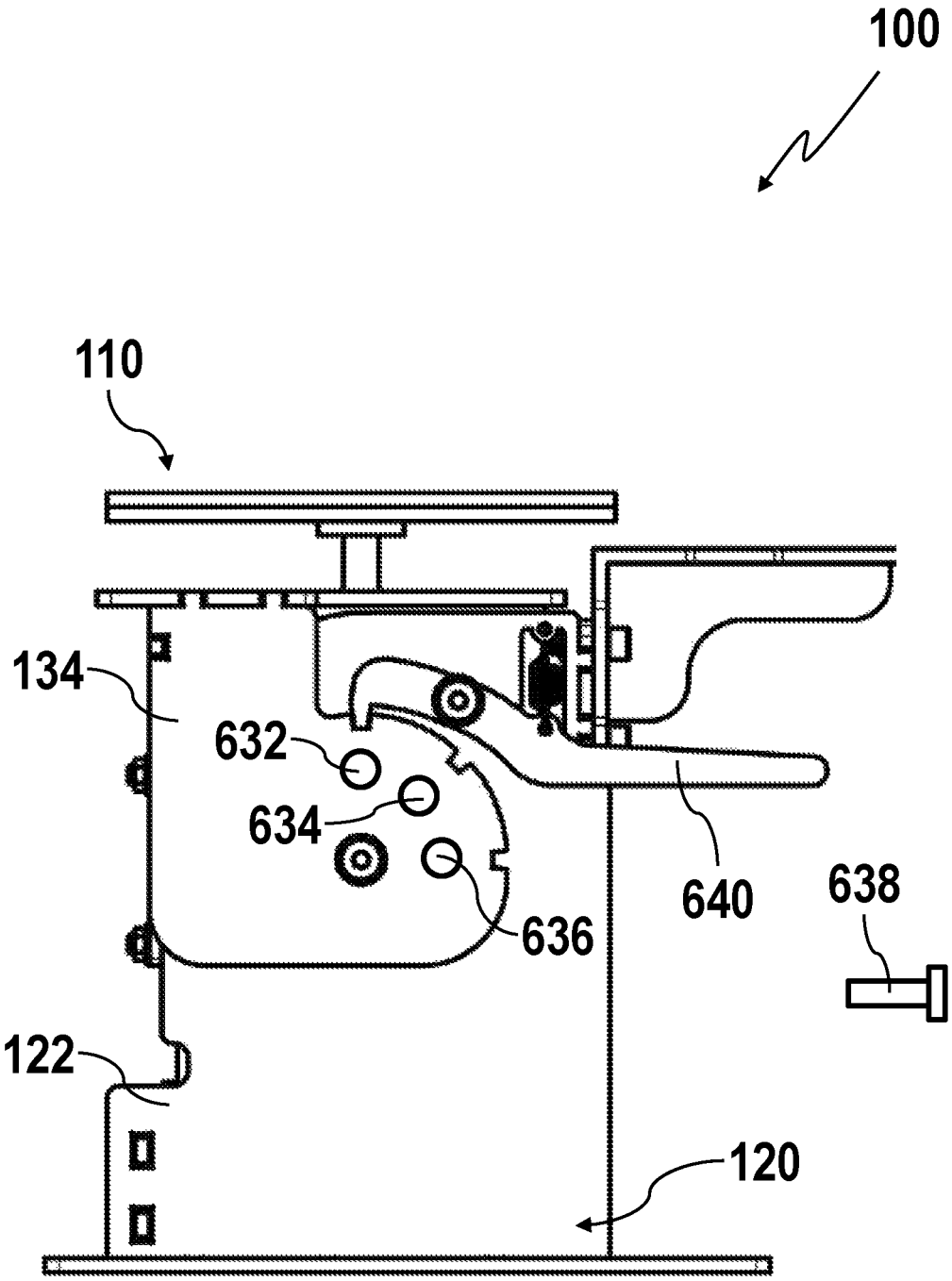
FIG. 6 is a side view illustration of a plurality of slotted cutouts, in accordance with the first exemplary embodiment of the present disclosure.

FIG. 6 is a side view illustration of a plurality of slotted cutouts 632, 634, 636, in accordance with the first exemplary embodiment of the present disclosure. The apparatus 100 may include the grinder 110, grinder base 120, first arm 134, and locking arm 640, as discussed relative to FIGS. 1-5 above. The first arm 134 may include a plurality of discrete slotted cutouts 632, 634, 636 located a spaced distance apart from one another. In one example, the slotted cutouts 632, 634, 636 may be arranged in an arcuate pattern. The arcuate pattern may correspond to at least a portion of a circle. At least one of the cutouts 632, 634,636 may align with a similar cutout in the first arm 134, and the other cutouts may align with the similar cutout when the first arm 134 is rotated. In operation, a fastener, such as a cotter pin 638 may be inserted into at least one of the cutouts 632, 634, 636 and the corresponding cutout in the first arm 134 in order to fix the position of the grinder 110 as it is rotatably adjusted.

Figure 7:
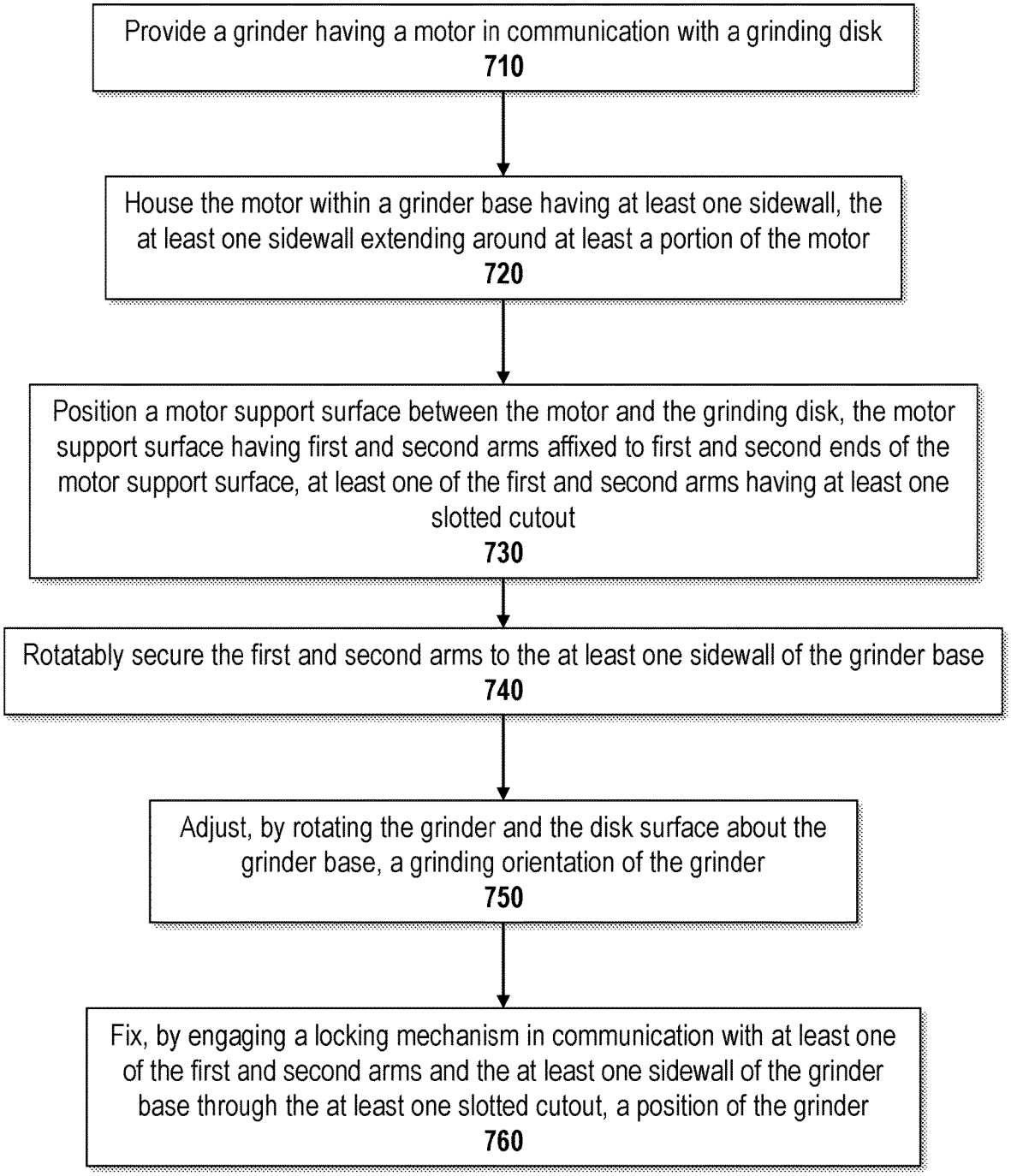
FIG. 7 is a flowchart illustrating a method for adjusting an orientation of a grinder, in accordance with the first exemplary embodiment of the present disclosure.

FIG. 7 is a flowchart 700 illustrating a method for adjusting an orientation of a grinder, in accordance with the first exemplary embodiment of the present disclosure. It should be noted that any process descriptions or blocks in flow charts should be understood as representing modules, segments, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

Step 710 includes providing a grinder having a motor in communication with a grinding disk.

Step 720 includes housing the motor within a grinder base having at least one sidewall, the at least one sidewall extending around at least a portion of the motor. The grinder base may be at least partially enclosed. The motor may fit within an interior volume of the grinder base.

Step 730 includes positioning a motor support surface between the motor and the grinding disk, the motor support surface having first and second arms affixed to first and second ends of the motor support surface, at least one of the first and second arms having at least one slotted cutout. The motor support surface may be positioned over the motor before the grinding disk is attached to the motor.

Step 740 includes rotatably securing the first and second arms to the at least one sidewall of the grinder base. Bolts may be installed through the first and second arms and the at least one sidewall to rotatably secure the first and second arms. In one example, the bolts may be located along an axis about which the first and second arms rotate.

Step 750 includes adjusting, by rotating the grinder and the motor support surface about the grinder base, a grinding orientation of the grinder. The motor support surface and grinder may be rotated to any suitable angle. In one example, a locking mechanism may be disengaged before the grinder and the motor support surface may be rotated. The locking mechanism may include a locking arm and a handle that may be tightened and loosened.

Step 760 includes fixing, by engaging a locking mechanism in communication with at least one of the first and second arms and the at least one sidewall of the grinder base through the at least one slotted cutout, a position of the grinder. The locking mechanism may fix the position and orientation of the grinder such that the grinding disk remains substantially fixed during use.

The method may further include any other features, components, or functions disclosed relative to any other figure of this disclosure.

Figure 8:
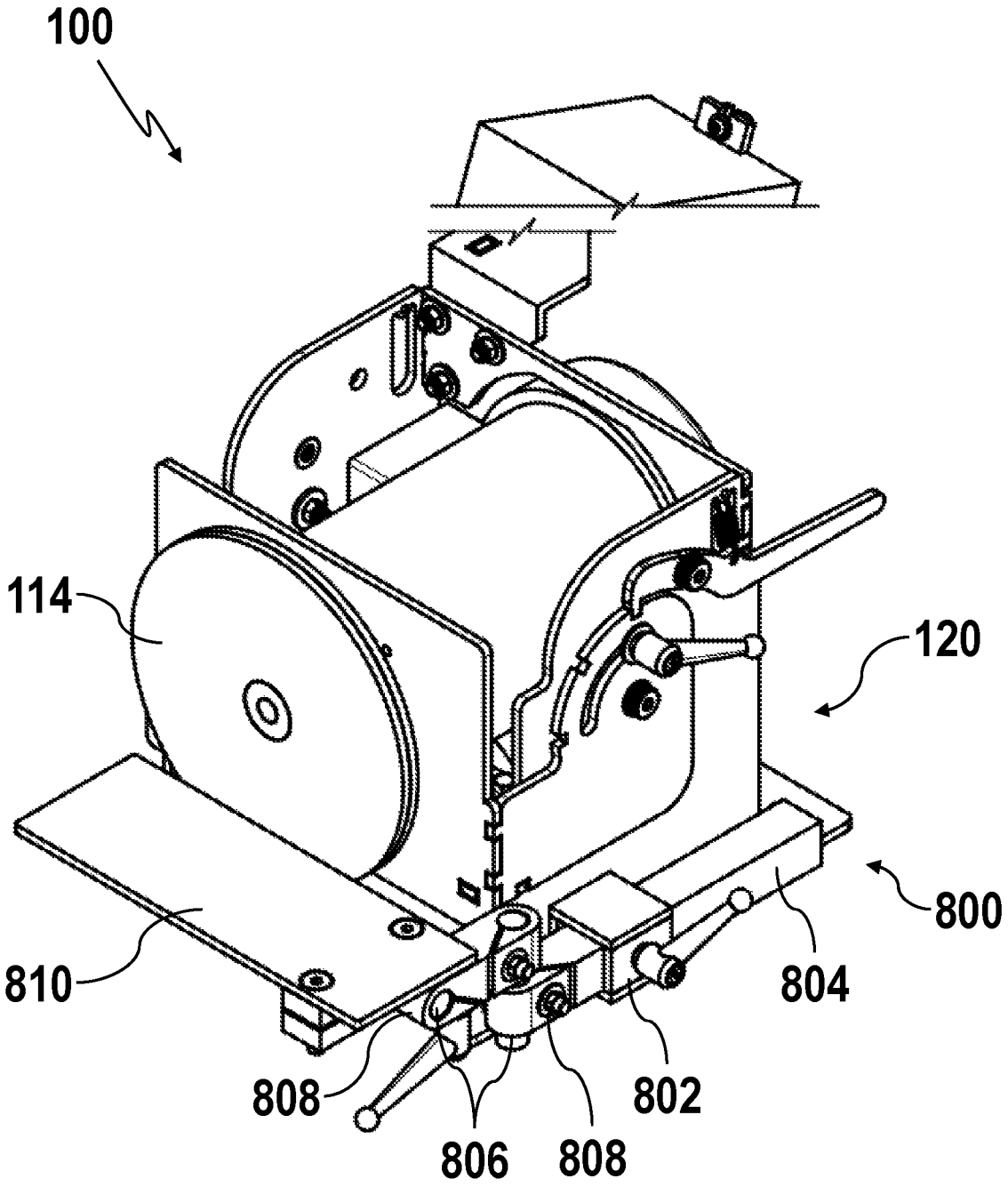
FIG. 8 is an isometric illustration showing a work rest with the adjustable grinding apparatus, in accordance with the first exemplary embodiment of the disclosure.

FIG. 8 is an isometric illustration showing a work rest 800 with the adjustable grinding apparatus 100, in accordance with the first exemplary embodiment of the disclosure. The work rest 800 may include a support block 802, which may be affixed to the grinder base 120. In one example, the support block 802 may be affixed to any side of the grinder base 120, for instance the left, front, or right sides. The support block 802 may be affixed using any suitable means, including a clamping handle, welding, adhesives, and the like. A support bar 804 may be positioned through the support block 802. The position of the support bar 804 may be adjustable in order to adjust a position of a support table 810. In one example, a threaded handle may be used to secure the position of the support bar 804 once adjusted. Cylindrical support rods 806 may be positioned within knuckle bars 808 to adjust the tilt and rotation of the support table 810. The support table 810 may be affixed to a knuckle bar 808 and may be rotated or adjusted by a user. When rotated or adjusted, the work surface created by the support table 810 may allow the user to operate the apparatus 100 at desired grinding angles, for instance, by configuring the support table 810 relative to the grinding disk 114 while maintaining the orientation of the grinding disk 114.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations am intended to be included herein within the scope of this disclosure and the present disclosure and protected by the following claims.

What is claimed is:

1. An adjustable grinding apparatus, comprising:

a grinder having a motor in communication with a grinding disk;

a grinder base housing the motor, the grinder base having at least one sidewall extending around at least a portion of the motor, an adjustable motor support comprising:

a motor support surface positioned between the motor and the grinding disk; and first and second arms affixed to first and second ends, respectively, of the motor support surface and rotatably secured to the at least one sidewall of the grinder base, at least one of the first and second arms having at least one slotted cutout; and a locking mechanism in communication with at least one of the first and second arms and the at least one sidewall of the grinder base through the at least one slotted cutout;

wherein the grinder and the adjustable motor support are rotatable about the grinder base to adjust a grinding orientation of the grinder, and wherein a position of the grinder is fixable by tightening the locking mechanism.

2. The apparatus of claim 1, wherein the grinder base has at least two sidewalls on substantially opposite sides of a base plate.

3. The apparatus of claim 1, further comprising a controller bracket affixed to the grinder base and a speed controller in communication with the motor.

4. The apparatus of claim 1, wherein the at least one slotted cutout is arcuate.

5. The apparatus of claim 1, having a plurality of slotted cutouts arranged in an arcuate position.

6. The apparatus of claim 1, wherein the locking mechanism comprises a threaded handle tightenable to fix the position of the grinder.

7. The apparatus of claim 1, wherein the locking mechanism comprises a locking arm engageable within a plurality of stops located on a radial edge of the first arm.

8. The apparatus of claim 1, wherein the grinding orientation is adjustable between a vertical orientation and a horizontal orientation.

9. The apparatus of claim 1, further comprising a work rest affixed to a side of the grinder base.

10. The apparatus of claim 1, further comprising a front motor plate connected to the motor support surface, the front motor plate affixed to the motor.

11. An adjustable housing for a grinder, comprising:

a grinder base having an interior volume and at least one sidewall extending around at least a portion of the interior volume;

a motor support surface;

first and second arms affixed to first and second ends, respectively of the motor support surface and rotatably secured to the at least one sidewall of the grinder base; and a locking mechanism in communication with at least one of the first and second arms and the at least one sidewall of the grinder base;

wherein the motor support surface is rotatable about the grinder base to adjust an orientation of the motor support surface, and wherein a position of the motor support surface is fixable by engaging the locking mechanism.

12. The housing of claim 11, wherein the grinder base has at least two sidewalls on substantially opposite sides of a base plate.

13. The housing of claim 11, further comprising a controller bracket affixed to the grinder base and a speed controller in communication with the motor.

14. The housing of claim 11, wherein the locking mechanism comprises a threaded handle tightenable to fix the position of the grinder, the threaded handle positioned through an arcuate slotted cutout in one of the first and second arms.

15. The housing of claim 11, wherein the locking mechanism comprises a locking arm rotatably affixed to the at least one sidewall, the locking arm engageable within a plurality of stops located on a radial edge of the first arm.

16. The housing of claim 15, wherein the plurality of stops correspond to grinding orientations of 0°, 45°, and 90°.

17. The housing of claim 11, wherein the grinding orientation is adjustable between a vertical orientation and a horizontal orientation.

18. The housing of claim 11, wherein the first and second arms are exterior to the at least one sidewall.

19. The housing of claim 11, further comprising a front motor plate connected to the motor support surface, the front motor plate affixed to the motor.

20. A method for adjusting an orientation of a grinder, comprising the following steps:

providing a grinder having a motor in communication with a grinding disk;

housing the motor within a grinder base having at least one sidewall, the at least one sidewall extending around at least a portion of the motor;

positioning a motor support surface between the motor and the grinding disk, the motor support surface having first and second arms affixed to first and second ends of the motor support surface, at least one of the first and second arms having at least one slotted cutout;

rotatably securing the first and second arms to the at least one sidewall of the grinder base;

adjusting, by rotating the grinder and the motor support surface about the grinder base, a grinding orientation of the grinder; and fixing, by engaging a locking mechanism in communication with at least one of the first and second arms and the at least one sidewall of the grinder base through the at least one slotted cutout, a position of the grinder.

* * * * *